US007644648B2

(12) United States Patent
Minowa et al.

(10) Patent No.: US 7,644,648 B2
(45) **Date of Patent: *Jan. 12, 2010**

(54) MAGNET TYPE RODLESS CYLINDER

(75) Inventors: Naoki Minowa, Tokyo (JP); Hiroshi Yoshida, Tokyo (JP); Akiyoshi Horikawa, Tokyo (JP); Mitsuo Noda, Ichinomiya (JP)

(73) Assignees: Howa Machinery, Ltd., Kiyosu-Shi (JP); Koganei Corporation, Tokyo (JP)

( * ) Notice: Subject to any disclaimer, the term of this patent is extended or adjusted under 35 U.S.C. 154(b) by 255 days.

This patent is subject to a terminal disclaimer.

(21) Appl. No.: 11/666,682

(22) PCT Filed: Mar. 14, 2005

(86) PCT No.: PCT/JP2005/004874

§ 371 (c)(1),
(2), (4) Date: May 1, 2007

(87) PCT Pub. No.: WO2006/048953

PCT Pub. Date: May 11, 2006

(65) Prior Publication Data

US 2008/0000347 A1 Jan. 3, 2008

(30) Foreign Application Priority Data

Nov. 2, 2004 (JP) ..... 2004-319678

(51) Int. Cl.
*F15B 15/14* (2006.01)
*F16H 49/00* (2006.01)

(52) U.S. Cl. ..... 92/88; 92/169.1

(58) Field of Classification Search ..... 92/88, 92/169.1

See application file for complete search history.

(56) References Cited

U.S. PATENT DOCUMENTS

| | | | | |
|---|---|---|---|---|
| 3,893,378 | A | 7/1975 | Hewitt | |
| 4,601,234 | A * | 7/1986 | Hoinkis | 92/88 |
| 6,148,714 | A * | 11/2000 | Abe et al. | 92/88 |
| 2001/0015580 | A1 * | 8/2001 | Sato et al. | 310/12 |

FOREIGN PATENT DOCUMENTS

| | | |
|---|---|---|
| GB | 470.088 | 8/1937 |
| GB | 470088 | 8/1937 |
| JP | 60-172711 | 9/1985 |
| JP | 63-162108 | 10/1988 |
| JP | 1-320304 | 12/1989 |
| JP | 2-33903 | 3/1990 |
| JP | 3-44213 | 4/1991 |
| JP | 3-140606 | 6/1991 |
| JP | 03140606 A * | 6/1991 |
| JP | 3-81009 | 12/1991 |
| JP | 4-10407 | 3/1992 |

(Continued)

*Primary Examiner*—Thomas E Lazo
(74) *Attorney, Agent, or Firm*—Finnegan, Henderson, Farabow, Garrett & Dunner, L.L.P.

(57) ABSTRACT

A pair of independent cylinder holes 3, 3 are formed in a cylinder tube 2 of a flat outer shape. When a pressurized fluid is alternately supplied into the cylinder tube 2 through a port 7 formed in an end cap 5, the internal pressure for operating the cylinders acts uniformly on the cylinder tube 2 greatly decreasing stress and deflection of the cylinder tube 2.

7 Claims, 11 Drawing Sheets

FOREIGN PATENT DOCUMENTS

| | | |
|---|---|---|
| JP | 4-52606 | 5/1992 |
| JP | 4-113305 | 10/1992 |
| JP | 4-357310 | 12/1992 |
| JP | 2514499 | 7/1996 |
| JP | 9-217708 | 8/1997 |
| JP | 11-270510 | 10/1999 |
| JP | 2002-295414 | 10/2002 |
| JP | 2003-278716 | 10/2003 |

* cited by examiner (PRIOR ART)

MAGNET TYPE RODLESS CYLINDER

TECHNICAL FIELD

The present invention relates to a magnet-type rodless cylinder in which pistons are magnetically coupled to a slide body, the pistons being arranged in cylinder holes in a cylinder tube of a nonmagnetic material so as to move in the axial direction of the cylinder tube, and the slide body being arranged on the outer circumferential surface of the cylinder tube so as to move in the axial direction of the cylinder tube.

BACKGROUND ART

In conventional magnet-type rodless cylinders, in general, a mechanism is utilized in that as pistons having inner magnets on the circumferential surfaces move due to internal pressure, a slide body having outer magnets magnetically coupled to the inner magnets moves being attracted by the motion of the inner magnets.

The magnitude of the attracting force is called "magnetic holding force" and is used as an index that represents the conveying ability of a magnet-type rodless cylinder.

FIG. 19 is a view schematically illustrating a general magnet-type rodless cylinder conventional design.

In FIG. 19, four outer magnets 102 of a slide body 101 on the outer side of a tube 100, and four inner magnets 104 of a piston 103 on the inner side of the tube 100 are arranged placing yokes 105 therebetween in a manner so that the same poles are opposed to each other in the axial direction. Further, the inner magnets 104 and the outer magnets 102 are arranged so that different magnet poles are opposed to each other.

Here, the magnetic holding force is defined as the force acting on the slide body in the axial direction 101 when the inner magnets 104 are deviated (displaced) in the axial direction relative to the slide body 101 (outer magnets 102) while applying a fluid pressure to the piston 103 without permitting the slide body 101 to move in the axial direction.

FIG. 4B is a diagram schematically illustrating the relationship between the amount of deviation (amount of displacement) of the inner magnets 104 and the magnetic holding force. In a static state where no fluid pressure is applied as shown in FIG. 4B, i.e., in a state where four inner magnets 104 and four outer magnets 102 are at positions, which are in alignment with each other in the radial direction without being deviated in the axial direction, the magnetic holding force becomes zero at point A. Magnetic holding force increases as the deviation between the inner magnets 104 and the outer magnets 102 in the axial direction increases, and becomes a maximum value Max (point B) when the deviation is about one-half of the pitch L of the magnets 102, 104 in the axial direction.

JP-UM-A-4-113305 discloses an art for flattening the cross sections of the cylinder tube and of the piston in the radial direction, in order to decrease the size of the device, by decreasing the thickness of the cylinder or to increase the cylinder thrust.

JP-A-4-357310 discloses a magnet-type rodless cylinder in which the cylinder tube and piston are formed in an oblong circular shape, in an oval shape or in a symmetrical pear shape in the radial direction in cross section.

Further, Japanese Utility Model Registration No. 2514499 discloses the arrangement of two magnet-type rodless cylinders in parallel having a slider, which strides the pair of cylinders.

JP-B-3-81009 discloses a rodless cylinder of the slit tube-type, the cylinder tube having two cylinder holes. The pistons are arranged in the cylinder holes, and are mechanically coupled to a slide body on the outer side of the tube through slits sealed with bands.

Further, U.S. Pat. No. 3,893,378 discloses a rodless cylinder of the slit tube-type, the tube having a rectangular outer shape in cross section and a cylinder hole having a quadrilateral shape.

JP-A-9-217708 discloses a cylinder of the rod-type, the cylinder tube having two cylinder holes.

British Patent No. 470088 discloses a rodless cylinder of the slit tube-type, the cylinder tube of a non-circular outer shape having three cylinder holes.

JP-UM-B-4-010407 discloses a magnet-type rodless cylinder in which a notch is formed in a slide body for passing a mounting member.

JP-B-3-81009, U.S. Pat. No. 3,893,378 and British Patent No. 470088 are related to the technologies of slit tube-type rodless cylinders, while JP-A-9-217708 is related to the technology of a rodless cylinder. These patent documents are referred to in this specification as general background art in the field of fluid pressure cylinders.

In general magnet-type rodless cylinders utilized in the field, the exactly circular cylindrical tube undergoes uniform deformation if the internal pressure of fluid is applied thereto. In tubes having a flat and noncircular outer shape as taught in JP-UM-A-4-113305 and JP-A-4-357310, since only one cylinder hole of a noncircular shape is formed, the tube is not uniformly deformed when the internal pressure of fluid is applied thereto, and therefore, maximum stress and maximum deflection are substantial.

To avoid this, the thickness of the tube must be greatly increased, and thereby a problem occurs in that the magnet-type rodless cylinder will not work unless the magnetic coupling force is also increased by several fold. Previously, therefore, two exactly circular cylindrical tubes were arranged in parallel as taught in the Japanese Utility Model Registration No. 2514499. However, the structure required for arranging a plurality of tubes in parallel as taught in Japanese Utility Model Registration No. 2514499 involves a cumbersome assembly operation, as well as increased space for installation, which are not desirable.

When the general magnet-type rodless cylinder is in a static state, the inner magnets 104 and outer magnets 102 are in alignment attracting each other in the radial direction in FIG. 19 without being deviated in the axial direction. Therefore, magnetic holding force is zero.

Therefore, if the piston 103 is attempted to be moved in this state, the motion is not smooth and a stick-slip phenomenon at the start of the slide body 101 occurs, since the outer magnets 102 are not attracted to the inner magnets 104 until the above "deviation" occurs.

The above problem occurs even with the device having a tube of a noncircular outer shape as taught in JP-UM-A-4-113305 and JP-A-4-357310. The same problem occurs between the cylindrical tubes and the slide body even with the constitution taught in Japanese Utility Model Registration No. 2514499 in that two of an exactly circular cylindrical tubes are arranged in parallel maintaining a relatively long distance.

DISCLOSURE OF THE INVENTION

In view of the above problems inherent in the prior art, it is an object of the present invention to provide a magnet-type rodless cylinder having a cylinder tube that is capable of suppressing the deflection and stress caused by the internal pressure despite the outer shape in cross section being noncircular.

Another object of the present invention is to provide a magnet-type rodless cylinder which moves smoothly at the start of movement.

In order to achieve the above object according to the invention of claim 1, there is provided a magnet-type rodless cylinder comprising pistons accommodated in cylinder holes formed in a cylinder tube made of a nonmagnetic material so as to move in the axial direction of the cylinder tube; and a slide body arranged on the outer circumference of the cylinder tube so as to move in the axial direction of the cylinder tube, and is magnetically coupled to the pistons; wherein the plurality of independent cylinder holes are formed in the cylinder tube, and the pistons are arranged in the cylinder holes, the pistons being magnetically coupled to the slide body; and the cylinder tube is formed in a noncircular outer shape in cross section.

According to the invention of claim 2, there is provided the magnet-type rodless cylinder of claim 1, wherein the cylinder tube is of a flat noncircular outer shape in cross section having a major axis and a minor axis, the sectional shape thereof inclusive of the cylinder holes being symmetrical with respect to the center line passing through the center of the length of the major axis.

According to the invention of claim 3, there is provided the magnet-type rodless cylinder of claim 2, wherein the cylinder tube is of an oblong circular outer shape in cross section, and exactly circular cylinder holes in cross section, and arranged in the direction of major axis of the cylinder tube in cross section.

According to the invention of claim 4, there is provided the magnet-type rodless cylinder of claim 2, wherein the cylinder tube is of an oblong circular outer shape in cross section, and the cylinder holes are of a quadrangle shape in cross section and arranged in the direction of the major axis of the cylinder tube in cross section.

According to the invention of claim 5, there is provided the magnet-type rodless cylinder of any one of claims 1 to 4, wherein the slide body is provided with outer magnets arranged on the inner side of the slide body and magnetically coupled to the pistons via the outer magnets; the outer magnets have a notch in at least one place in the outer circumference of the cylinder tube in cross section; and an axial member is arranged in the notch along the axial direction of the cylinder tube.

According to the invention of claim 6, there is provided the magnet-type rodless cylinder of any one of claims 1 to 5, wherein the pistons are each provided with a plurality of inner magnets arranged in the axial direction of the cylinder tube and are magnetically coupled to the slide body via inner magnets; the magnetic pole arrangement of the inner magnets is such that the same poles are opposed to each other among the inner magnets neighboring in the axial direction of the cylinder tube, and the same poles are opposed to each other among the inner magnets of the pistons neighboring each other; the slide body is provided with a plurality of outer magnets arranged on the inner side of the slide body in the axial direction, and is magnetically coupled to the pistons via the outer magnets; and the magnetic pole arrangement of the outer magnets is such that the same poles are opposed to each other in the axial direction and different poles are opposed to the magnetic poles of the inner magnets.

According to the invention of claim 7, there is provided the magnet-type rodless cylinder of any one of claims 1 to 5, wherein the pistons are each provided with a plurality of inner magnets arranged in the axial direction of the cylinder tube and are magnetically coupled to the slide body via inner magnets; the inner magnets are magnetized so that the magnetic poles opposing each other are different in the radial direction of the pistons, but are the same in the axial direction, and the same poles are opposed to each other among the inner magnets of the pistons neighboring each other; the slide body is provided with a plurality of outer magnets arranged on the inner side of the slide body in the axial direction and is magnetically coupled to the pistons via the outer magnets; and the outer magnets are magnetized so that the magnetic poles are different in the radial direction of the cylinder tube, but are the same in the axial direction, and the different poles are opposed to the magnetic poles of the inner magnets.

According to the invention, there is provided the magnet-type rodless cylinder of any one of claims 1 to 4, wherein permanent magnets are provided for either the pistons or the slide body, magnetic members are provided for the other one, and the pistons and slide body are magnetically coupled together via permanent magnets and magnetic members.

According to the invention, there is provided the magnet-type rodless cylinder of any one of claims 1 to 6, wherein the pistons are each provided with a plurality of inner magnets arranged in the axial direction of the cylinder tube, and are magnetically coupled to the slide body via the inner magnets; and the cylinder holes are arranged at positions, which are close to each other to such a degree that the pistons accommodated in the cylinder holes are held at positions deviated relative to each other in the axial direction of the cylinder tube due to the repulsive magnetic force acting among the inner magnets of the pistons in the axial direction of the cylinder tube.

In the present invention, the "quadrangle" means a quadrangle having vertexes of right angles inclusive of a rectangle, as well as a square. Further, those in which a quadrangle having rounded corners are also included.

In the invention of claim 1, the cylinder tube of the magnet-type rodless cylinder is of a noncircular outer shape in cross section having a plurality of cylinder holes. Thus, when compared with the case where only one cylinder hole is formed in the cylinder, the deflection and stress when internal pressure is applied can be suppressed to a sufficiently low level even when the thickness of the cylinder tube is decreased to a practical level.

It is therefore possible to provide a magnet-type rodless cylinder using the cylinder tube of a noncircular outer shape without greatly increasing the magnetic coupling force between the pistons and the slide body, unlike that of the prior art. Further, since the slide body is moved by using a plurality of pistons, the cylinder thrust can be easily increased. Therefore, when a large thrust is not required, the pressure-receiving areas of the pistons can be decreased, i.e., the cylinder hole diameter can be decreased to further decrease size and weight.

In the invention of claim 2, the cylinder holes have a sectional shape, which is symmetrical with respect to the center line passing through the center of the length of the major axis. Therefore, the cylinder tube is well balanced in right-and-left directions in the cross section, and can be easily formed by a drawing or extrusion process.

In the invention of claim 3, the cylinder holes are of a exactly circular shape. Therefore, pistons of a conventional shape can be accommodated therein, and conventional parts can be utilized.

In the invention of claim 4, on the other hand, the cylinder holes are of a square shape enabling the pressure-receiving areas of the pistons to be increased compared with cylinder holes of an exactly circular shape. When the cylinder as a whole has the same external size, cylinder thrust can be increased.

In the invention of claim 5, a guide rail is attached as an axial member to the cylinder tube, and a guide member guided along the guide rail is attached to the slide body, to smoothly guide the slide body along the direction of the cylinder tube. By forming a notch in the slide body, an intermediate portion of the cylinder tube in the lengthwise direction thereof can be supported by a tube-attaching member, which is the axial member along the lengthwise direction of the cylinder tube.

According to the magnetic pole arrangement of the invention of claim 6, a large magnetic holding force can be maintained between the pistons and the slide body.

According to the magnetic pole arrangement of the invention of claim 7, magnet size can be increased, and magnetic holding force can be increased between the pistons and the slide body.

According to the invention, in particular, the outer magnets of the slide body are omitted, and instead, magnetic members are used to make the cylinder compact as a whole.

In the invention described, the inner magnets of the pistons arranged in the plurality of cylinder holes repel each other in the axial direction of the cylinder tube being affected by the magnetic forces, and come to a halt in a state of being slightly deviated in the axial direction with respect to the slide body, which is in a static state. Therefore, due to the "deviation", a magnetic holding force is produced between the inner magnets and the slide body in a static state, suppressing the occurrence of stick slip at the start of movement and enabling the magnet-type rodless cylinder to operate smoothly.

BRIEF DESCRIPTION OF THE DRAWINGS

FIGS. 4A and 4B are a view and a diagram illustrating the deviation of the inner and outer magnets and the magnetic holding force, wherein FIG. 4A illustrates a constitution of the magnet-type rodless cylinder according to the present invention and FIG. 4B is a diagram of a relationship between the deviation of the inner and outer magnets and the magnetic holding force;

BEST MODE FOR CARRYING OUT THE INVENTION

Figure 1:
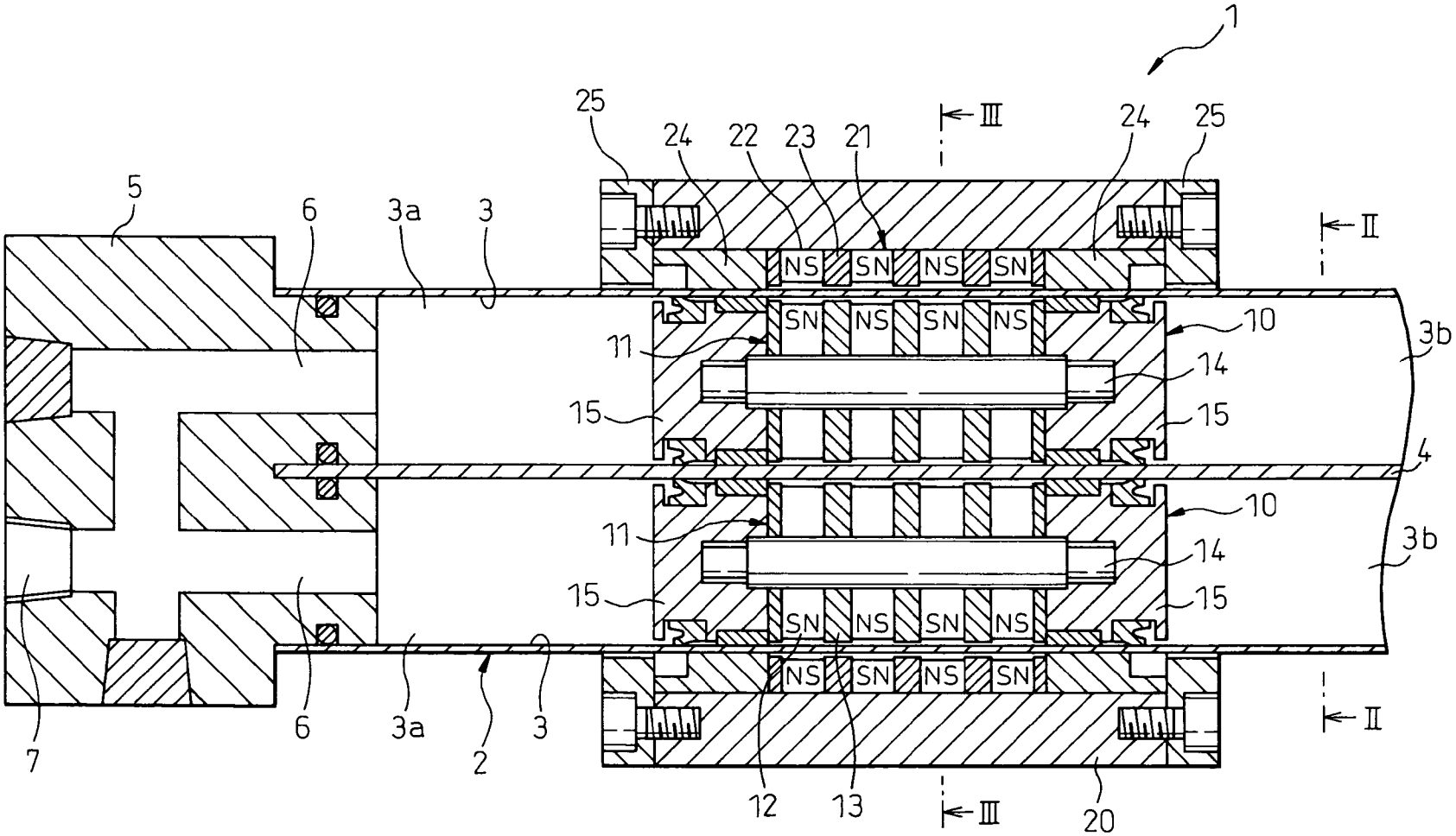
FIG. 1 is a longitudinal sectional view of a magnet-type type rodless cylinder according to the invention.

An embodiment of the invention will now be described with reference to FIGS. 1 to 3.

A cylinder tube 2 of a magnet-type rodless cylinder 1 of this embodiment is formed in a cylindrical shape by a nonmagnetic material, such as drawn or extruded aluminum alloy.

However, the cylinder tube 2 may be made of stainless steel, a resin material or porcelain instead of aluminum alloy.

End caps 5 are fitted to the ends of the cylinder tubes 2 in the lengthwise direction thereof to close the two cylinder holes 3, 3. The end caps 5 are of flat shapes, which are long in a direction in which the cylinder tubes are lined (direction along the straight line connecting the centers of the two cylinder tubes of a circular shape in cross section) and is short in the direction of thickness (direction of axis of the cylinder). On the end caps 5, supply/discharge ports 7 for the working fluid, as well as flow paths 6, 6 communicated with the cylinder holes 3, 3 are formed.

Figure 2:
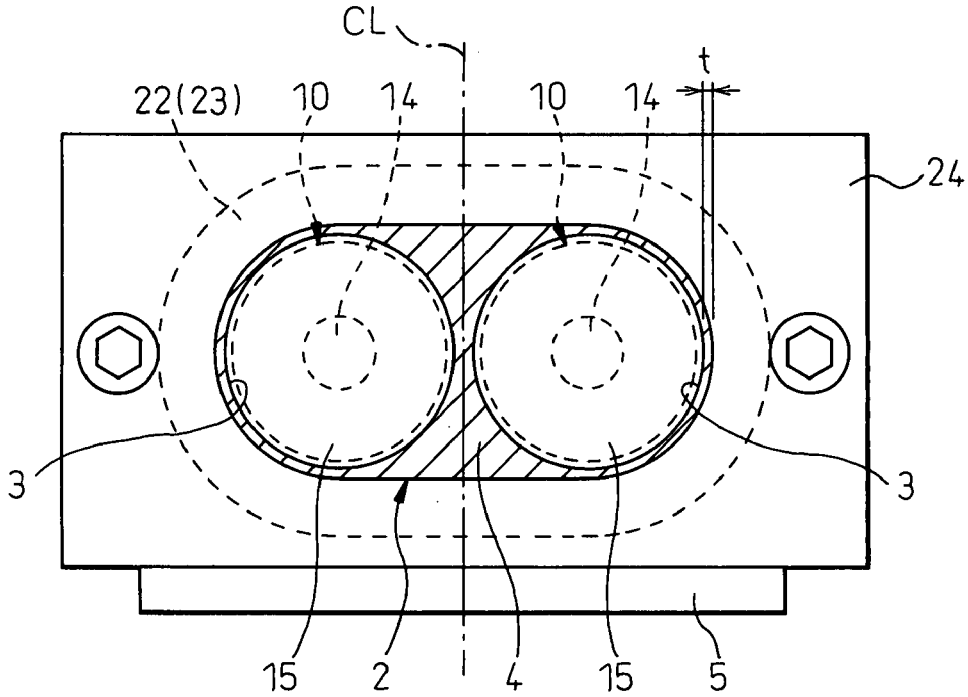
FIG. 2 is a sectional view along the line II-II in FIG. 1.
Figure 3:
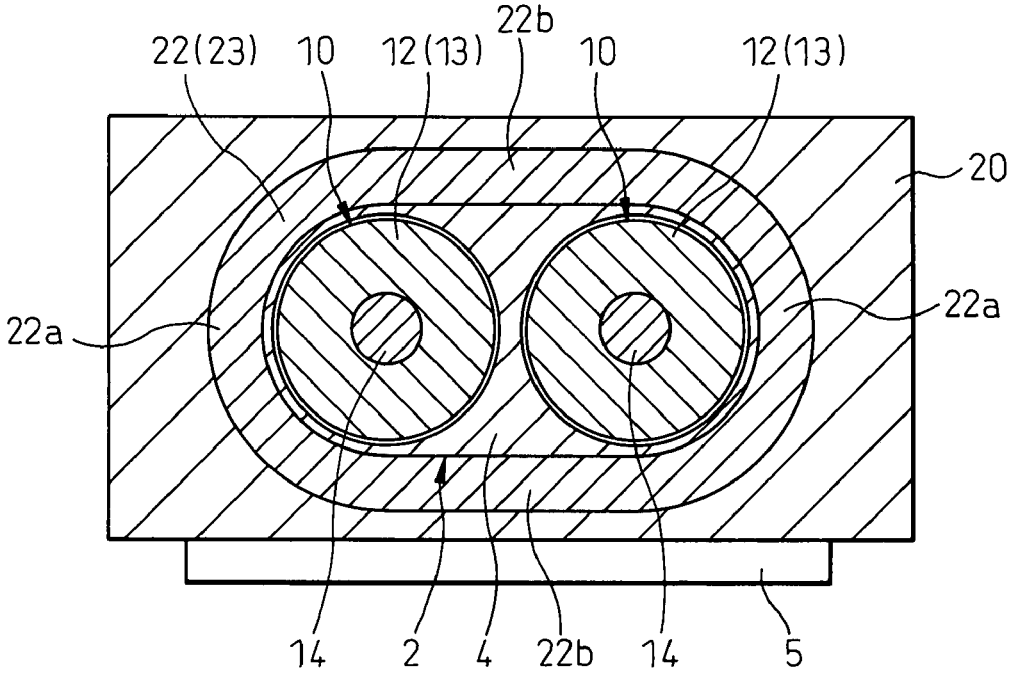
FIG. 3 is a sectional view along the line III-III in FIG. 1.

Referring to FIGS. 2 and 3, the cylinder tube 2 is formed in a flat oblong circular outer shape in cross section having a major axis (axis in a horizontal direction in FIG. 2) and a minor axis (axis in the vertical direction in FIG. 2), and includes a pair of exactly circular cylinder holes 3 and 3 of the same shape arranged in parallel in the direction of the major axis and close to each other with a separator wall 4 therebetween.

The cylinder tube 2 including cylinder holes 3 and 3 is symmetrical in cross section with the minor axis CL positioned at a center in the direction of major axis as an axis of symmetry.

The degree of closeness of cylinder holes 3 and 3 is roughly set so that a repulsive force is produced in the axial direction among the inner magnets 12 provided in the pistons 10 in a state where the pistons 10 are arranged in the cylinder holes 3 and 3 of the cylinder tube 2. As will be described later, the inner magnets 12 of the pistons 10 are slightly deviated in the axial direction relative to the outer magnets 22 of the slide body 20.

The cylinder holes 3 and 3 are accommodating the pistons 10 so as to move in the axial direction, are sectionalized into right and left chambers 3*a*, 3*b* by the pistons 10, and are sealed with packing.

In each piston 10, reference numeral 11 denotes a row of inner magnets. The row 11 of inner magnets is constituted by inner magnets 12 of four pieces of permanent magnets of a doughnut shape having a circular circumference, and yokes 13. The inner magnets 12 and the yokes 13 are alternately fitted onto a piston shaft 14, and are fastened and fixed at both ends in the axial direction by piston ends 15.

In this embodiment, the magnetic poles of the inner magnets 12 are arranged as shown in FIG. 1 in a manner that the same poles are opposed to each other among the inner magnets neighboring each other for example SN, NS, SN, NS in the axial direction, and further the same poles are opposed to each other among the inner magnets 12 of the neighboring pistons 10, 10.

Next, the slide body 20 is arranged on the outer circumference of the cylinder tube 2 so as to move in the axial direction. The slide body 20 is made of an aluminum alloy in a flat shape, which is long in a direction in which the cylinder holes 3 are lined in parallel and is short in the direction of thickness at right angles with the direction in which the cylinder holes 3 are lined in parallel.

A row 21 of outer magnets is arranged on the inner circumferential surface of the slide body 20. The row 21 of outer magnets has an inner circumferential shape in agreement with the outer circumferential shape of the cylinder tube 2. The row 21 of outer magnets is formed by four pieces of outer magnets 22 and yokes 13 alternately arranged in the axial direction, and are fixed by fastening the end plates 25 against outer wear rings 24 disposed on both ends of the row 21. The outer magnets 22 are permanent magnets having the shape of an oblong circular ring and the yokes 13 have the shape of an oblong circular ring which is similar to the permanent magnets. The shape of the outer magnets are formed by semicircular portions 22*a* corresponding to the semicircular portions on both sides of the cross section of the cylinder tube and straight portions 22*b* disposed therebetween and joining the semicircular portions 22*a*.

The magnetic poles of the row 21 of outer magnets, are arranged so that the same poles are opposed to each other among the outer magnets 22 neighboring each other in the axial direction, but that different magnetic poles are opposed to the magnetic poles of the opposing row 11 of inner magnets, for example NS, SN, NS, SN.

That is, the row 11 of inner magnets and the row 21 of outer magnets attract each other to magnetically couple the two pistons 10 with the slide body 20, and the slide body 20 moves together with the pistons 10 and 10.

Between the rows 11, 11 of inner magnets of the pair of neighboring pistons 10, 10, the repulsive magnetic force is acting in both the direction of major axis of the cylinder tube in cross section and the axial direction of the cylinder tube due to the above magnetic pole arrangement.

Due to the repulsive magnetic force in the axial direction of the tube, the inner magnets 12 of the piston 10 in the static state are held at positions slightly deviated relative to the outer magnets 22 in the axial direction of the tube.

Figure 4A:
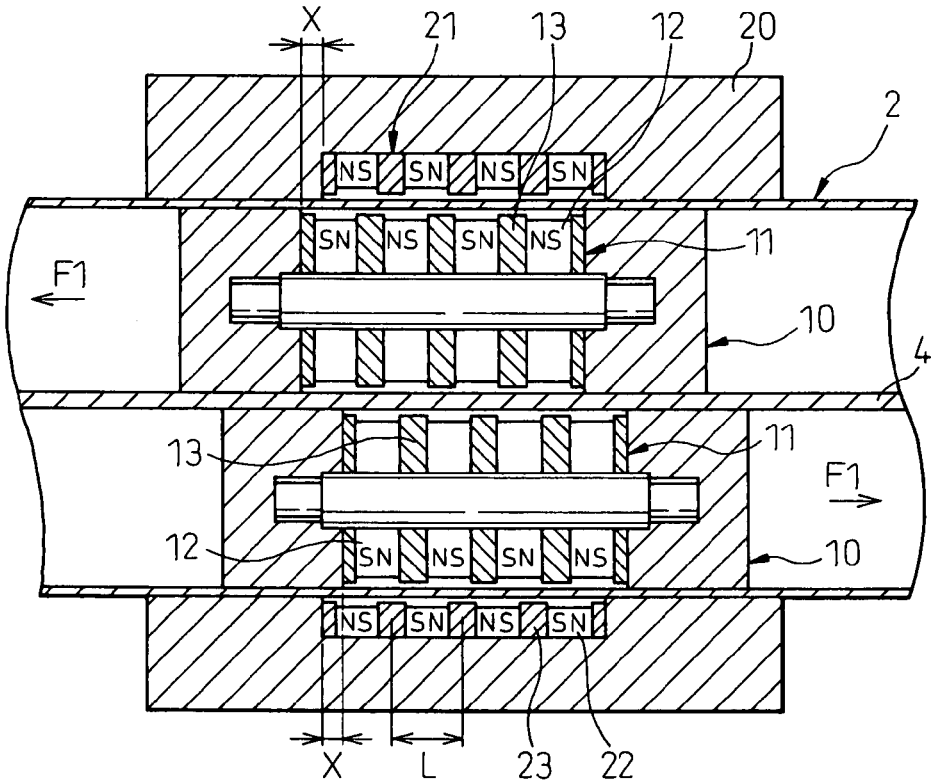
Figure 19:
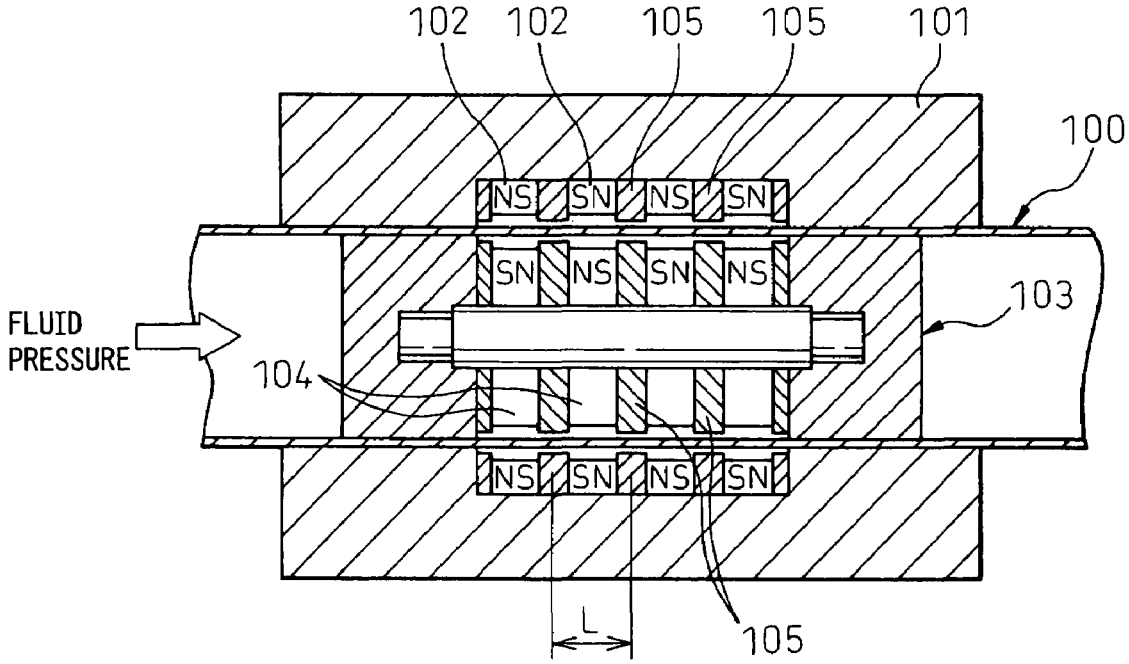
(PRIOR ART) Fig.19
FIG. 19 is a sectional view of a conventional magnet-type rodless cylinder for illustrating the relationship between the deviation of inner and outer magnets and the magnetic holding force.

FIG. 4A is a view illustrating the above deviated state in an exaggerated manner. In the static state, the two neighboring pistons 10, 10 are receiving a repulsive force F1 in the axial direction due to the magnetic pole arrangement of the inner magnets 12. Due to the repulsive magnetic force F1, the inner magnets 12, 12 of the pistons 10, 10 cannot stay at rest at positions where they are in alignment with the outer magnets 22 of the slide body 20 (e.g., positions of FIG. 19). Therefore, the pistons 10, 10 remain at rest at positions deviated from the slide body 20 by "X" in the axial direction.

Figure 4B:
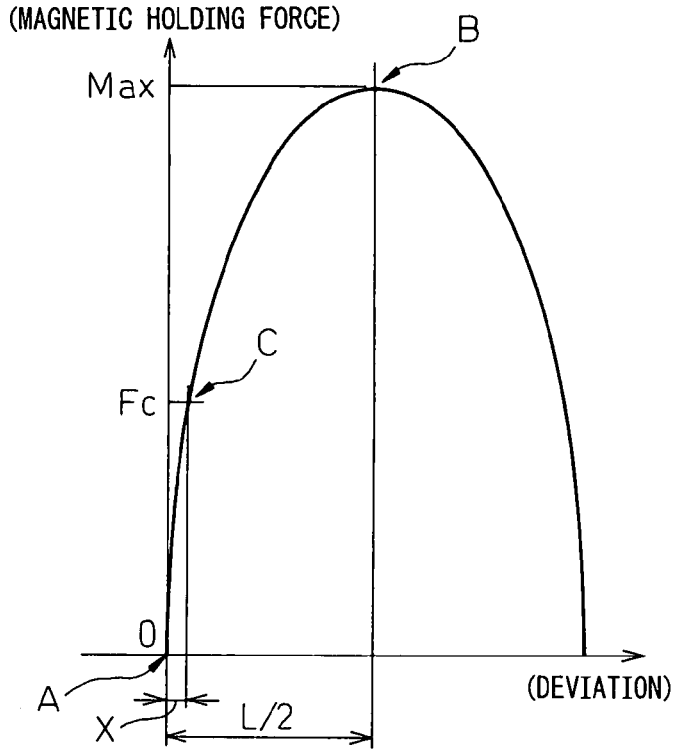

Due to this "deviation X", a magnetic holding force Fc represented at point C in FIG. 4B is generated between the rows 12 and 22 of inner and outer magnets. Here, as shown in FIG. 4A, the directions of deviation are different for the pair of pistons 10, but the amount of deviation is the same.

Next, described below is the initial motion of the pistons 10 in a static state. In the state shown in FIG. 4A, if compressed air is supplied into the cylinder tube 2 from the port 7 formed in the end cap 5, the two pistons 10 move in the cylinder tube 2 in the axial direction of the cylinder tube, and therefore, the slide body 20 moves correspondingly on the outer side of the cylinder tube 2 in the axial direction of the cylinder tube.

In this embodiment, however, the magnetic holding force Fc is produced between the outer magnets 22, and the inner magnets 12 even in a static state. Therefore, the occurrence of the stick slip phenomenon is suppressed compared with the conventional art (FIG. 19) where the motion starts from a static state where no magnetic holding force is produced, and therefore, the slide body 20 starts moving smoothly.

In this embodiment, further, though the cylinder tube 2 has a flat circumferential shape, the pair of cylinder holes 3 and 3 are formed in the cylinder tube 2. Therefore, even when the internal pressure of the cylinder working fluid is applied onto the cylinder tube 2, the internal pressure applied onto the cylinder tube 2 is uniform compared with that of the prior art, which has only one cylinder hole in the cylinder tube of a flat outer circumferential shape, and therefore, stress and deflection can be greatly decreased.

Figure 18:
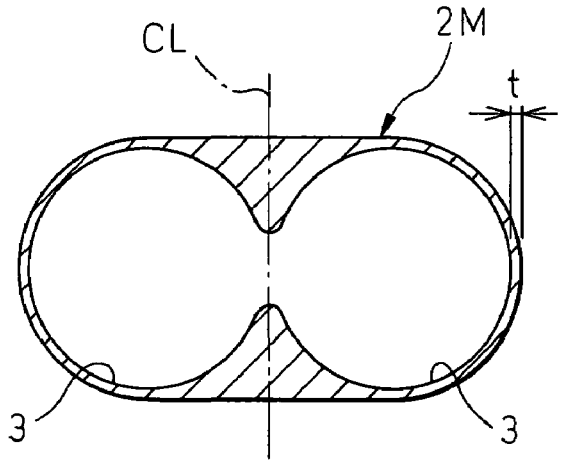
FIG. 18 is a sectional view of a conventional cylinder tube having cylinder holes of a conventional shape.

In order to verify this effect, a mechanical analysis was conducted relying upon a finite element method. As analytical models, a cylinder tube 2M (thickness t=1 mm) of the shape of a gourd having an oblong circular outer shape in cross section with one cylinder hole 3 as shown in FIG. 18 and the cylinder tube 2 (thickness t=0.7 mm) of the present invention arranged in a pair of exactly circular cylinder holes 3 and 3 in parallel as shown in FIGS. 1 to 3, were used. The mechanical analysis of these tubes relying upon the finite element method proved that the cylinder tube 2 of the present invention developed a maximum deflection of about 3/1000 mm despite its decreased thickness, which was about 1/100 of a maximum deflection of the cylinder tube 2M of the shape of FIG. 18.

As for the maximum stress, the cylinder tube 2 of the present invention shown in FIGS. 1 to 3 exhibited 17 N/mm$^2$, which was about 1/20 of the maximum stress of the cylinder tube 2M of FIG. 18. Thus, the cylinder tube of the present invention was virtually free from deflection and stress.

To verify this, a cylinder tube 2 having the above shape in cross section was produced for test purposes, and internal pressure was applied thereto to examine the deflection and stress, which were agreed with the results of analysis.

The cylinder holes 3 and 3 of the model used for the analysis had a diameter of 16 mm and the internal pressure was 1.05 MPa.

According to the magnet-type rodless cylinder 1 of this embodiment as described above, a pair of cylinder holes 3, 3 are independently formed in the cylinder tube 2, the pistons 10 arranged in the cylinder holes 3 are magnetically coupled to the slide body 20, and the cylinder tube 2 is formed in a flat noncircular outer shape in cross section. Therefore, when internal pressure is applied, the magnet-type rodless cylinder 1 of this embodiment develops less deflection and stress than those of with only one cylinder hole formed.

According to this embodiment, even when the thickness of the cylinder tube is decreased to a practical level, the deflection and stress of the cylinder tube can be suppressed to practical levels, and the cylinder tube does not have to be formed greatly thick like that of the prior art.

According to this embodiment, a flat magnet cylinder being short or less thick can be put into use without greatly increasing the magnetic coupling force between the pistons and slide body.

In this embodiment, since the slide body 20 is moved by a plurality of pistons 10, the cylinder thrust can be easily increased. Therefore, when a large thrust is not required, the pressure-receiving areas of the pistons may be decreased, i.e., the cylinder diameter may be decreased in order to decrease size and weight of the device.

In this embodiment as shown in FIGS. 1 to 3, in particular, the cylinder tube 2 has an oblong circular outer shape in cross section, which is symmetrical with respect to the major axis thereof. Therefore, the slide body 20 is able to smoothly slide while maintaining good balance and strength. Further, since the cylinder holes 3 are arranged in parallel in the direction of major axis of the cylinder tube in cross section, pistons 10 can be suitably arranged in the cylinder tube 2.

Described below are further examples of the sectional shape of the cylinder tube. Reference numerals which are the same as those of the above embodiment denote the same elements, and their description is not repeated.

Figure 5:
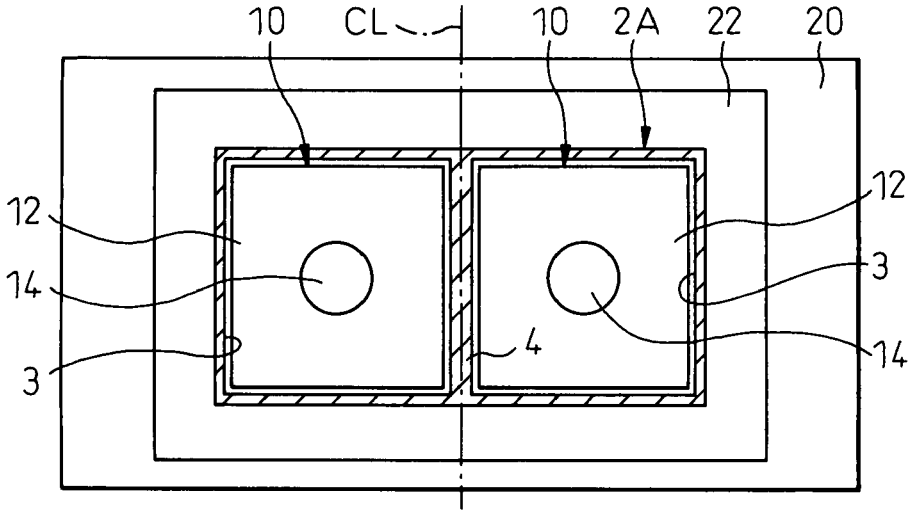
FIG. 5 is a sectional view illustrating a second embodiment of the invention, and corresponds to FIG. 3.

The rodless cylinder of FIG. 5 comprises a cylinder tube 2A of a rectangular outer shape, and includes a pair of cylinder holes 3, 3 of a square shape, which is a kind of quadrangle. The pistons 10 arranged in the quadrangle cylinder holes 3 and 3 are of a quadrangle shape in cross section, and are provided with the inner magnets 12 of a quadrangle shape in cross section.

The outer magnets 22 arranged on the inner side of the slide body 20 are magnetically coupled to the inner magnets 12, and are formed in a rectangular ring shape to agree with the outer shape of the cylinder tube 2. The magnetic pole arrangements of the inner magnets 12 and the outer magnets 22 are the same as those of the above embodiment.

Figure 6:
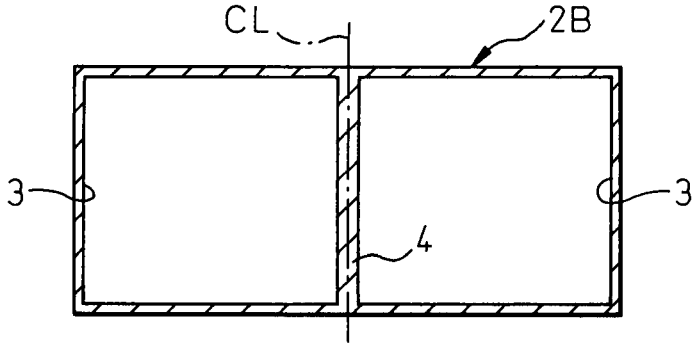
FIG. 6 is a sectional view of the cylinder tube according to a third embodiment.

The cylinder tube 2B of FIG. 6 has a rectangular outer shape, and a pair of cylinder holes 3, 3, which have a rectangular shape (a kind of quadrangle).

Figure 7:
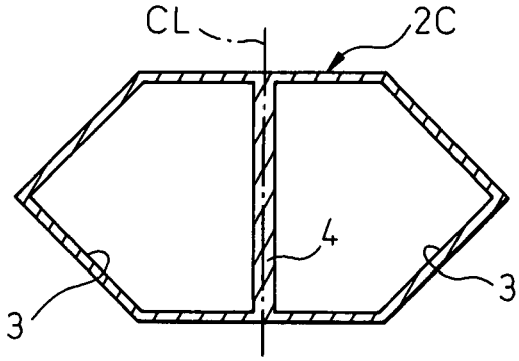
FIG. 7 is a sectional view of the cylinder tube according to a fourth embodiment.

The cylinder tube 2C of FIG. 7 has a flat hexagonal outer shape and includes cylindrical holes 3 and 3 of a pentagonal shape in cross section on both sides with a center line CL passing through the center of the length of the major axis.

Figure 8:
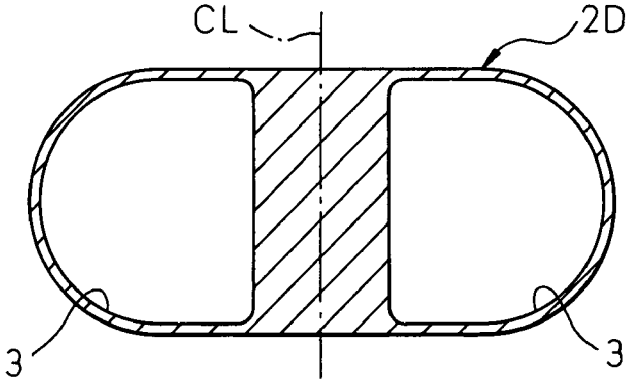
FIG. 8 is a sectional view of the cylinder tube according to a fifth embodiment.

A cylinder tube 2D of FIG. 8 has an oblong circular outer circumferential shape and includes a pair of cylinder holes 3 each having a cross section synthesized by a semicircle and a quadrangle.

Figure 9:
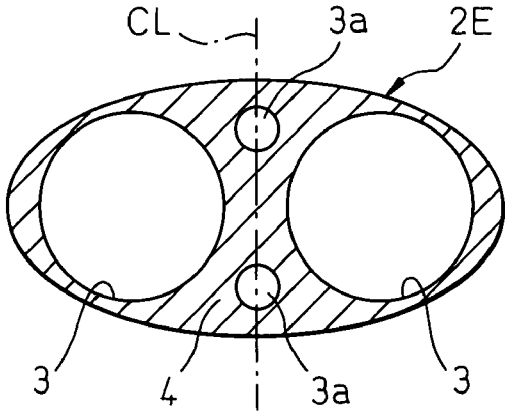
FIG. 9 is a sectional view of the cylinder tube according to a sixth embodiment.

A cylinder tube 2E of FIG. 9 has an oval outer circumferential shape and includes a pair of exactly circular cylinder holes 3. Flow paths 3*a* and 3*a* for cylinder holes 3, 3 are disposed between the cylinder holes 3, 3.

Figure 10:
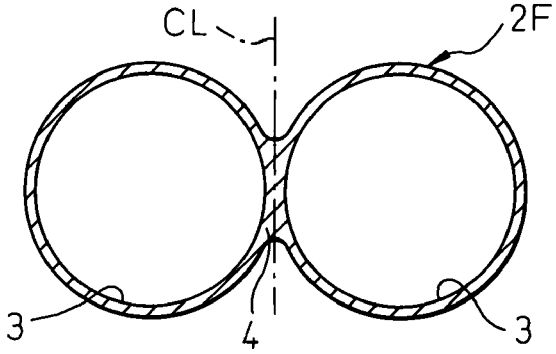
FIG. 10 is a sectional view of the cylinder tube according to a seventh embodiment.

A cylinder tube 2F of FIG. 10 has an outer circumferential shape (figure eight) along a pair of exactly circular cylinder holes 3 and 3 in cross section.

The cylinder tubes of FIGS. 5 to 10 are all of flat outer circumferential shapes having a major axis and a minor axis, and including the pair of cylinder holes 3 and 3 arranged in parallel in the direction of major axis of the cylinder tube in cross section, and symmetrical in cross section with respect to the center line CL passing through the center of the length of the major axis.

Figure 11:
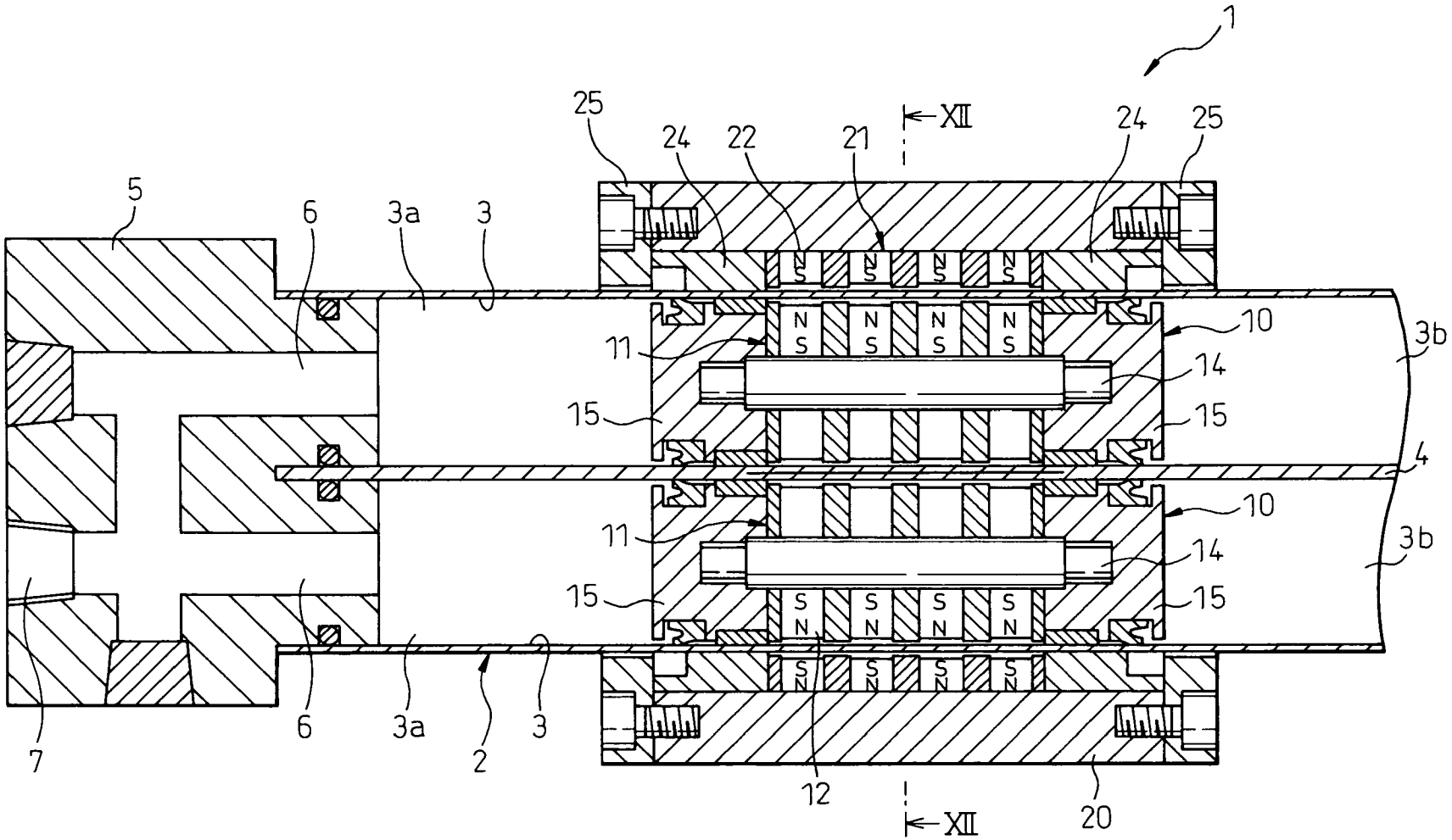
FIG. 11 is a longitudinal sectional view illustrating another magnetic pole arrangement of the inner and outer magnets.
Figure 12:
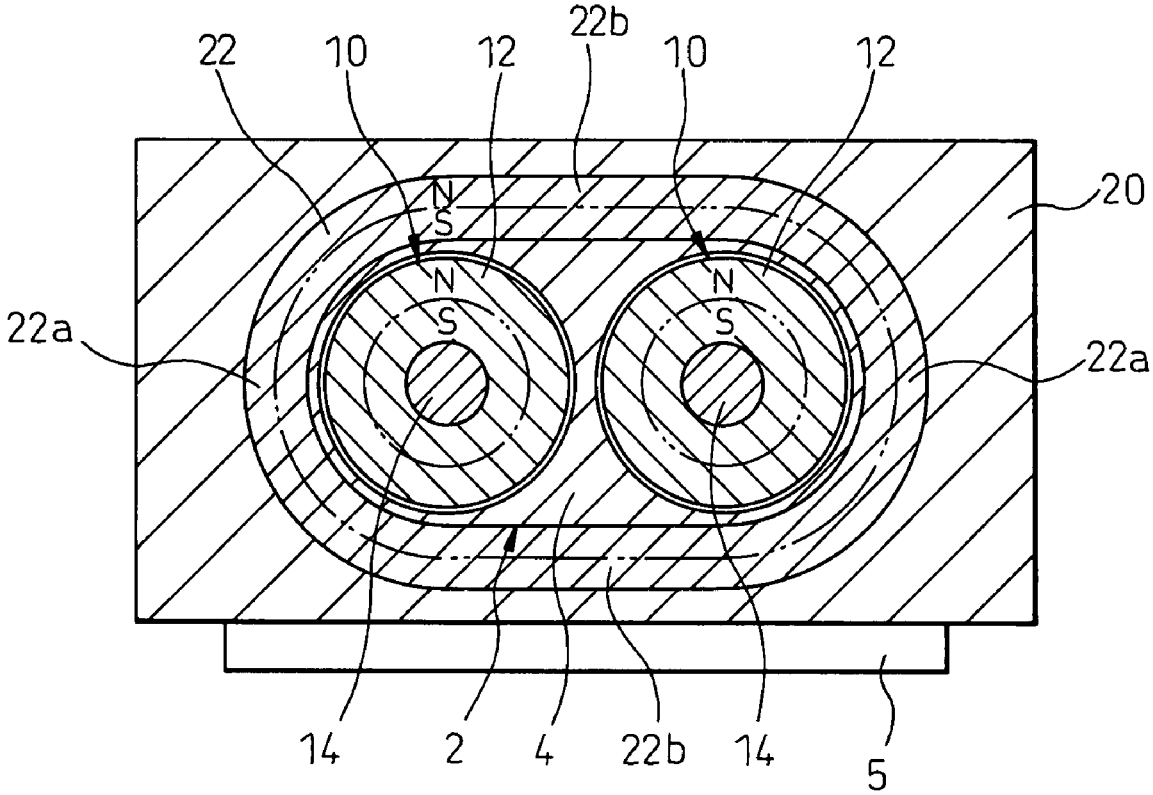
FIG. 12 is a sectional view along the line XII-XII in FIG. 11.

Next, described below with reference to FIGS. 11 and 12 is a magnetic pole arrangement of the inner magnets 12 and outer magnets 22 different from that of FIG. 1. In this embodiment, the inner magnets 12 are magnetized so that the S poles are on the inner side in the radial direction of the cylinder hole 3, the N poles are on the outer side, and the same poles are opposed to each other among the opposing inner magnets 12 of the pistons 10 and 10 neighboring each other. In the same piston, the inner magnets 12 are arranged so that the same poles are opposed in the axial direction of the cylinder tube or in the lengthwise direction of the piston 10. The outer magnets 22 are also magnetized so that the S poles are on the inner side in the radial direction of the cylinder tube, the N poles are on the outer side, and that the different poles are opposed to those of the opposing inner magnets 12 so as to attract each other.

Among the outer magnets 22, the same poles are opposed in the axial direction.

In the above embodiments, permanent magnets were used for the inner magnets and outer magnets provided for the pistons and the slide body. However, either one side of the magnets may be formed by using magnetic members so as to be sufficiently attracted by the permanent magnets of the other side. By using inexpensive magnetic members, thickness can be decreased and the cylinder can be further decreased in size and weight.

Figure 13:
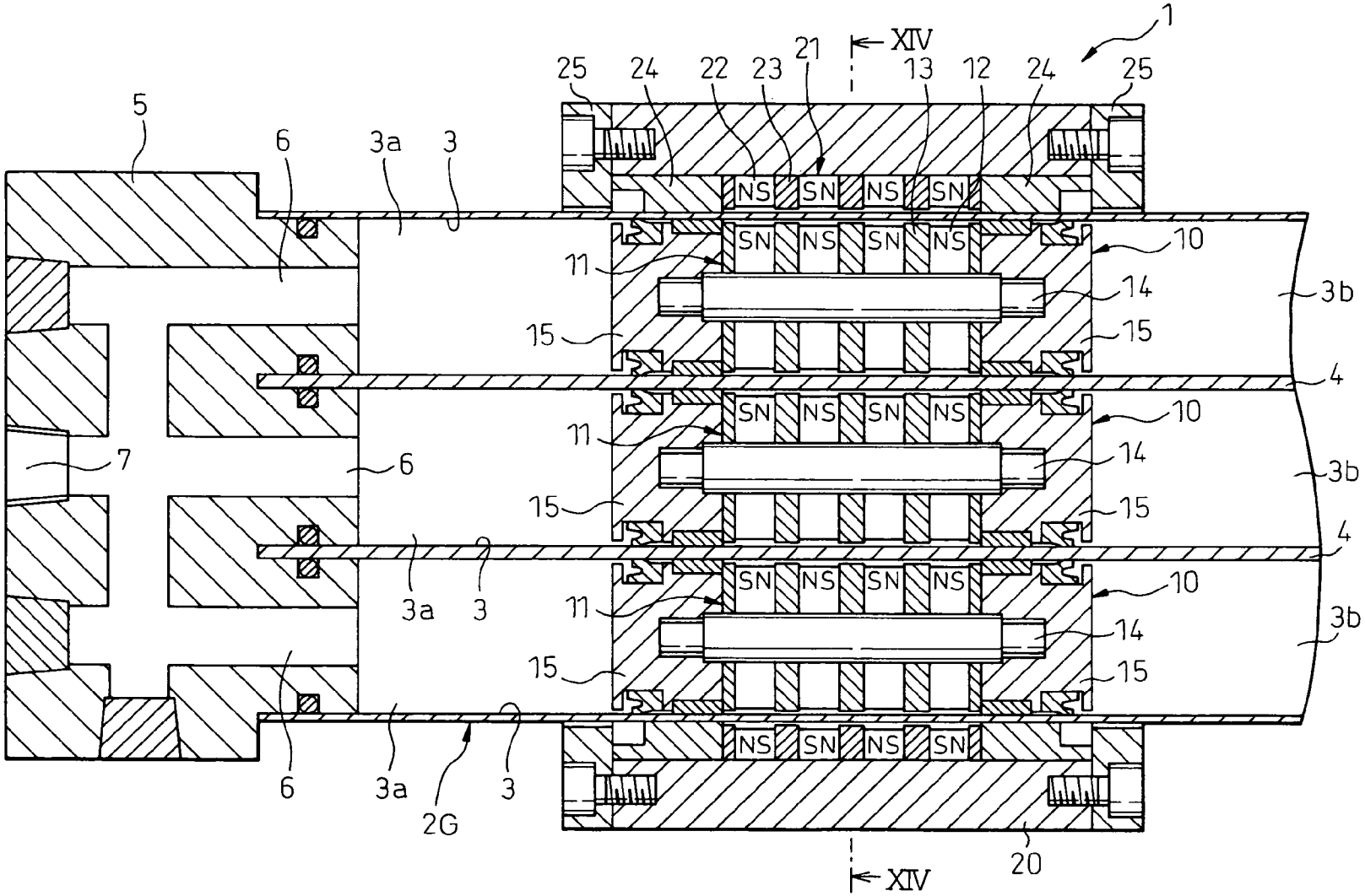
FIG. 13 is a longitudinal sectional view of a cylinder tube having three cylinder holes.
Figure 14:
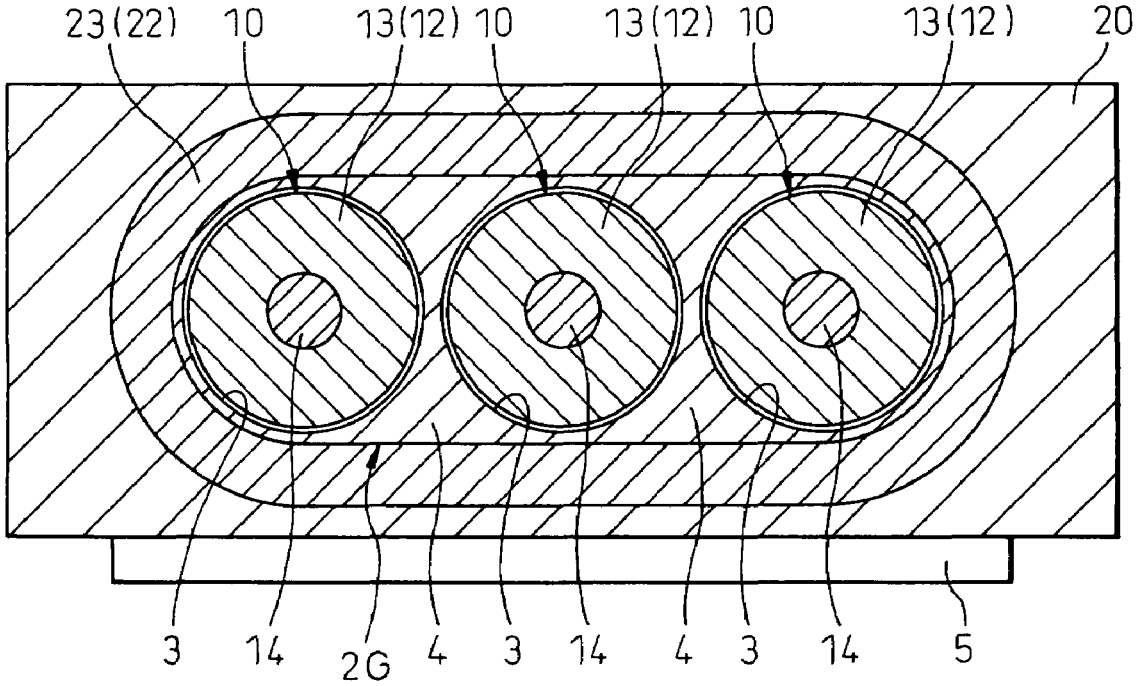
FIG. 14 is a sectional view along the line XIV-XIV in FIG. 13.

Further, the cylinder holes formed in the cylinder tube are not limited to a pair, but may be formed of three or more. FIGS. 13 and 14 illustrate magnet-type rodless cylinders having three cylinder holes formed in the cylinder tube. In FIGS. 13 and 14, the portions same as those of the first embodiment are denoted by the same reference numerals, but their description is not repeated.

A cylinder tube 2G of this embodiment is of a flat oblong circular outer shape in cross section as shown in FIG. 14 having a major axis and a minor axis, and includes three exactly circular cylinder holes 3, 3 and 3 of the same shape arranged in parallel while maintaining an equal distance in the direction of major axis with separator walls 4 sandwiched among them.

Figure 15:
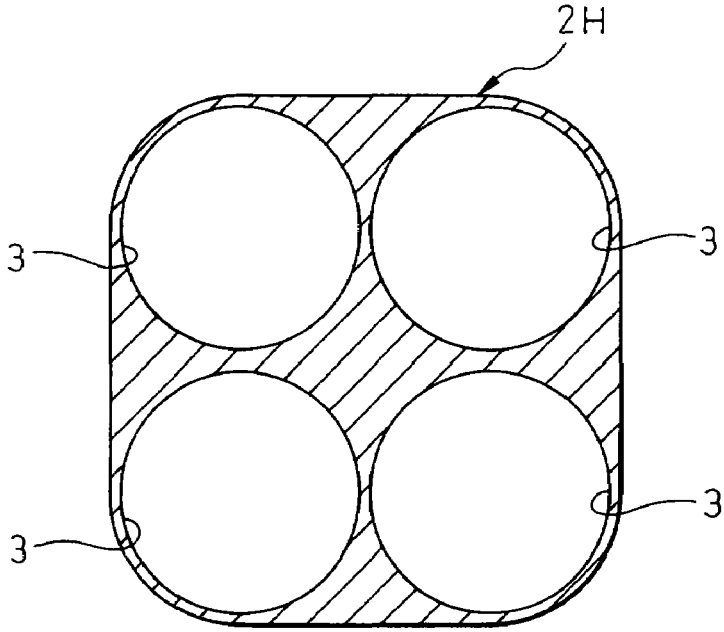
FIG. 15 is a view of a cylinder tube having four cylinder holes.

FIG. 15 is a sectional view of a cylinder tube 2H having four cylinder holes 3.

The rodless cylinder according to further embodiments of the invention will be described next with reference to FIGS. 16 and 17.

Figure 16:
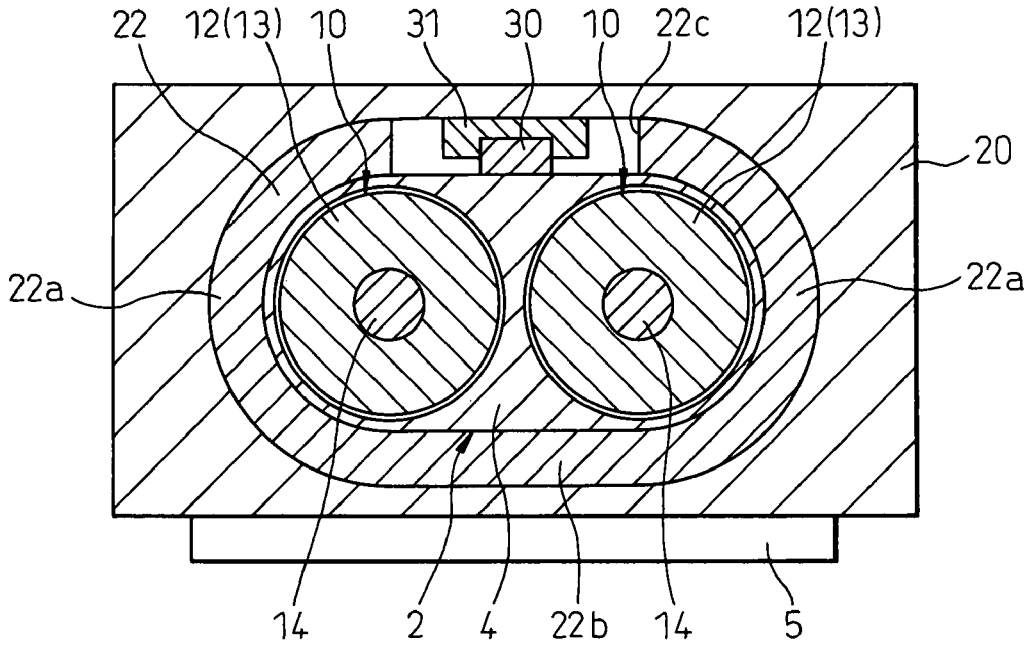
FIG. 16 is a sectional view of a case of having a straight guide rail.

In an embodiment of FIG. 16, the outer magnets 22 are not of an oblong circular ring shape, which completely corresponds to the whole circumference of the outer oblong circular shape of the cylinder tube 2, but have a notch 22*c* formed in one of the straight portions 22*b* of the outer magnets 22 as shown in FIG. 16. Further, the yokes 23 and the outer wear rings 24, are also of a shape having a notch corresponding to the above notch 22*c*.

On the upper surface of the cylinder tube 2 corresponding to the notch 22*c*, a straight guide rail 30, which is an axial member extending along the axial direction of the cylinder tube 2 is provided integrally with the cylinder tube. The straight guide rail 30 penetrates through the slide body 20 in the axial direction of the cylinder tube 2, and is partly positioned in the notch 22*c*.

A guide member 31 is attached to the slide body 20 so as to be guided straight by the straight guide rail 30. When the slide body 20 moves reciprocally along the cylinder tube 2 in this constitution, the slide body 20 is guided by the straight guide rail 30 via the guide member 31. Therefore, improved guiding precision of the slide body 20 is obtained, when compared with the case whether the slide body 20 is guided by the outer circumferential surface of the cylinder tube 2.

Next, a further embodiment will be described with reference to FIG. 17. In the embodiment shown in FIG. 17, the outer magnets 22 are cut in two places in the straight portions 22*b* thereof, and therefore, have notches 22*c* formed at the two places. The yokes 23 and outer wear rings 24, are also of a shape corresponding to the shape of the outer magnets 22.

Also in this embodiment, the straight guide rail 30 and the guide member 31 are arranged in the notch 22*c* on the upper side like those described above. Further, a notch (groove in the axial direction) 20*a* corresponding to the lower side notch is formed in the slide body 20 and end plates 25. The groove 20*a* extends continuously in the lengthwise direction of cylinder through both end plates 25 and the slide body 20.

Figure 17:
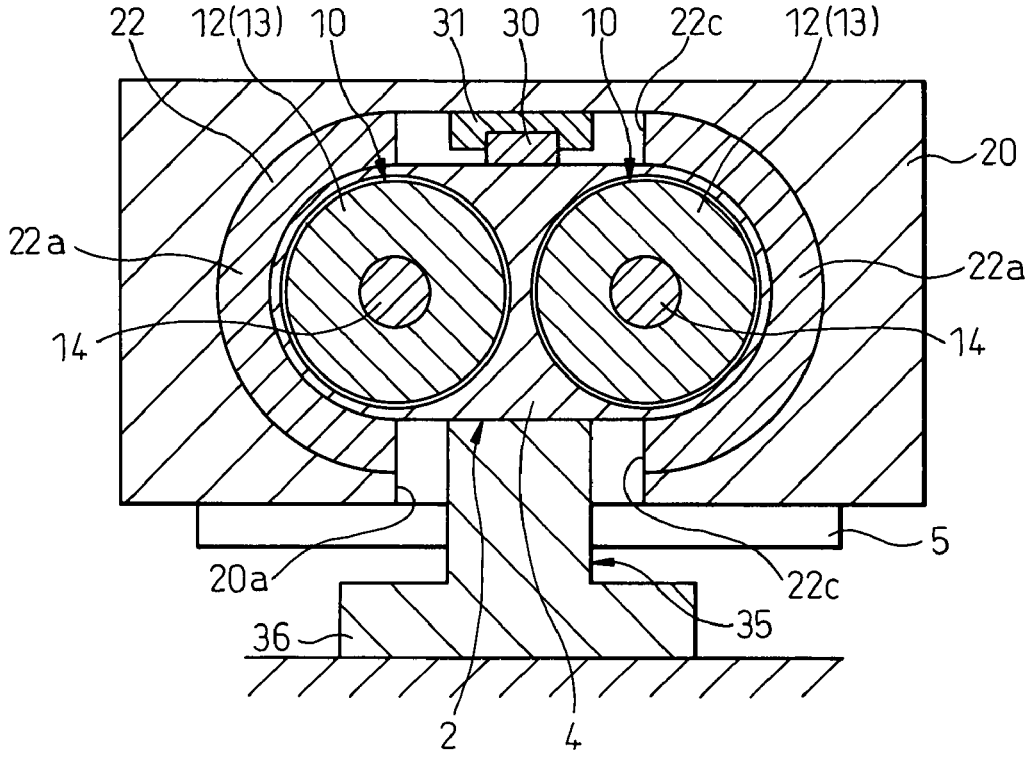
FIG. 17 is a sectional view of a case of having a straight guide rail and a mounting member.

In this embodiment as shown in FIG. 17, a mounting member (member in the axial direction) 35 is mounted on the lower surface of the cylinder tube 2 along the lengthwise direction of the cylinder tube 2 through notch 20*a* and notch 22*c*.

The mounting member 35 is fixed to a portion of a machine body where the rodless cylinder is to be mounted, and has a leg portion 36 that specifies the intermediate portion of the cylinder tube 2 in the lengthwise direction.

The mounting member 35 does not have to be continuous over the full length of the cylinder tube 2, but may be divided into several portions in the lengthwise direction. According to this embodiment, the intermediate portion in the lengthwise direction of the cylinder tube 2 is supported by a mounting member 35. Therefore, it is possible to prevent the deflection of the cylinder tube 2 and to enable the slide body 20 to move smoothly by guiding the slide body on the straight guide rail 30. In this embodiment, the magnet-type rodless cylinder may be such that the notch 22*c* is formed on the lower side only, and the mounting member 35 only is provided.

LIST OF REFERENCE NUMERALS

1—magnet type rodless cylinder
2, 2A to 2H—cylinder tubes
3—cylinder holes
10—pistons
11—row of inner magnets
12—inner magnets
20—slide body
21—row of outer magnets
22—outer magnets

The invention claimed is:

1. A magnet-type rodless cylinder comprising:

a plurality of pistons accommodated in a plurality of cylinder holes formed in a cylinder tube made of a nonmagnetic material so as to move in an axial direction of the cylinder tube; and a slide body arranged on an outer circumference of the cylinder tube that is moveable in the axial direction of the cylinder tube and that is magnetically coupled to said pistons; wherein, the plurality of cylinder holes are independent and are formed in said cylinder tube at close positions, said pistons being arranged in the cylinder holes, said cylinder tube has a noncircular outer shape in cross section, said pistons are each provided with a plurality of inner magnets arranged in the axial direction of the cylinder tube and are magnetically coupled to said slide body via said inner magnets; and said cylinder holes are arranged at positions which are close to each other to such a degree that the pistons accommodated in the cylinder holes are held at positions deviated relative to each other in the axial direction of the cylinder tube due to the repulsive magnetic force acting among the inner magnets of the pistons in the axial direction of the cylinder tube.

2. The magnet-type rodless cylinder of claim 1, wherein said cylinder tube has a flat noncircular outer shape in cross section having a major axis and a minor axis, the sectional shape thereof inclusive of the cylinder holes being symmetrical with respect to a center line (CL) passing through the center of a length of the major axis.

3. The magnet-type rodless cylinder of claim 2, wherein said cylinder tube has an oblong circular outer shape in cross section, and the cylinder holes have a circular shape in cross section and are arranged in the direction of the major axis of the cylinder tube in cross section.

4. The magnet-type rodless cylinder of claim 2, wherein the cylinder tube has a rectangular outer shape in cross section, and the cylinder holes have a quadrangle shape in cross section and are arranged in the direction of the major axis of the cylinder tube in cross section.

5. The magnet-type rodless cylinder of any one of claims 1 to 4, wherein said slide body is provided with outer magnets arranged on an inner side of the slide body so that said slide body is magnetically coupled to said pistons via said outer magnets, said outer magnets having a notch in at least one place in the whole outer circumference of the cylinder tube in cross section; and an axial member is arranged in said notch along the axial direction of the cylinder tube.

6. The magnet-type rodless cylinder of claim 1, wherein:

the magnetic pole arrangement of said inner magnets is such that the same poles are opposed to each other among the inner magnets neighboring in the axial direction of the cylinder tube and that the same poles are opposed to each other among the inner magnets of the pistons neighboring each other;

said slide body is provided with a plurality of outer magnets arranged on an inner side of the slide body in the axial direction so that said slide body is magnetically coupled to said pistons via said outer magnets; and the magnetic pole arrangement of said outer magnets is such that the same poles are opposed to each other in the axial direction and that different poles are opposed to the magnetic poles of said inner magnets.

7. The magnet-type rodless cylinder of claim 1, wherein:

said inner magnets are so magnetized that the magnetic poles opposing each other are different in a radial direction of the pistons, but are the same in the axial direction, and that the same poles are opposed to each other among the inner magnets of the pistons neighboring each other;

said slide body is provided with a plurality of outer magnets arranged on an inner side of the slide body in the axial direction so that said slide body is magnetically coupled to said pistons via said outer magnets; and said outer magnets are magnetized so that the magnetic poles opposing each other are different in the radial direction of the cylinder tube, but are the same in the axial direction, and the different poles are opposed to the magnetic poles of said inner magnets.

* * * * *